US009752598B2

(12) United States Patent
Nomura

(10) Patent No.: US 9,752,598 B2
(45) Date of Patent: Sep. 5, 2017

(54) FLUID PRESSURE CYLINDER

(71) Applicant: SMC CORPORATION, Chiyoda-ku (JP)

(72) Inventor: Kenji Nomura, Matsudo (JP)

(73) Assignee: SMC CORPORATION, Chiyoda-ku (JP)

( * ) Notice: Subject to any disclaimer, the term of this patent is extended or adjusted under 35 U.S.C. 154(b) by 37 days.

(21) Appl. No.: 14/786,078

(22) PCT Filed: Nov. 13, 2013

(86) PCT No.: PCT/JP2013/081222
§ 371 (c)(1),
(2) Date: Oct. 21, 2015

(87) PCT Pub. No.: WO2014/184976
PCT Pub. Date: Nov. 20, 2014

(65) Prior Publication Data

US 2016/0076560 A1 Mar. 17, 2016

(30) Foreign Application Priority Data

May 16, 2013 (JP) ..... 2013-103981

(51) Int. Cl.
*F15B 15/00* (2006.01)
*F15B 15/14* (2006.01)

(52) U.S. Cl.
CPC ..... *F15B 15/1438* (2013.01)

(58) Field of Classification Search
CPC ..... F15B 15/1438; F15B 15/1423; F15B 15/1428; F15B 15/1433
(Continued)

(56) References Cited

U.S. PATENT DOCUMENTS 2,719,510 A 10/1955 Elder et al.
2,755,775 A 7/1956 Flick et al.
(Continued)

FOREIGN PATENT DOCUMENTS

CN 100344882 C 10/2007
CN 101191509 A 6/2008
(Continued)

OTHER PUBLICATIONS

Combined Chinese Office Action and Search Report issued Jun. 17, 2016 in Patent Application No. 201380076593.3 (with English language translation).
(Continued)

*Primary Examiner* — F. Daniel Lopez
*Assistant Examiner* — Dustin T Nguyen
(74) *Attorney, Agent, or Firm* — Oblon, McClelland, Maier & Neustadt, L.L.P.

(57) ABSTRACT

A fluid pressure cylinder includes first through fourth stepped portions provided in a multi-stepped manner on a first spigot joint of a head cover, and first through fourth stepped portions provided similarly in a multi-stepped manner on a second spigot joint of a rod cover. A cylinder tube is installed selectively on any one pair of the first through fourth stepped portions. Consequently, by preparing a new cylinder tube that differs in diameter, along with a new piston, and then installing the cylinder tube selectively on any one pair of the first through fourth stepped portions, a fluid pressure cylinder having a different bore diameter is constructed.

6 Claims, 6 Drawing Sheets

(58) Field of Classification Search
USPC ..... 92/59, 128, 171.1, 152
See application file for complete search history.

(56) References Cited

U.S. PATENT DOCUMENTS

| | | | | |
|---|---|---|---|---|
| 3,122,063 | A * | 2/1964 | Chorkey | F15B 15/223 91/26 |
| 6,044,752 | A * | 4/2000 | Harigaya | F15B 15/1428 92/163 |
| 7,798,052 | B2 | 9/2010 | Ikari | |
| 2012/0107144 | A1 * | 5/2012 | Keifer | F04B 27/0404 417/53 |

FOREIGN PATENT DOCUMENTS

| | | | |
|---|---|---|---|
| CN | 102454662 | A | 5/2012 |
| CN | 102767548 | A | 11/2012 |
| DE | 44 38 196 | A1 | 10/1995 |
| DE | 20 2004 002852 | U1 | 5/2004 |
| DE | 10 2009 014 817 | A1 | 9/2010 |
| JP | 56-146105 | | 11/1981 |
| JP | 2010-266054 | A | 11/2010 |

OTHER PUBLICATIONS

International Search Report and Written Opinion of the International Searching Authority Issued Jul. 2, 2014 in PCT/JP13/081222 Filed Nov. 13, 2013.
Office Action issued May 26, 2015 in Taiwanese Patent Application No. 102141220 (with English translation).

* cited by examiner

FLUID PRESSURE CYLINDER

TECHNICAL FIELD

The present invention relates to a fluid pressure cylinder in which a piston is displaced in an axial direction under the supply of a pressure fluid.

BACKGROUND ART

Heretofore, as a transport means for a workpiece or the like, for example, a fluid pressure cylinder has been used having a piston that is displaced under the supply of a pressure fluid.

Such a fluid pressure cylinder, for example, as disclosed in Japanese Laid-Open Utility Model Publication No. 56-146105, includes a cylindrically shaped cylinder tube, a cylinder cover disposed on an end of the cylinder tube, and a piston provided displaceably in the interior of the cylinder tube. In addition, by supplying a pressure fluid to a port of the cylinder cover, the piston is pressed and displaced in an axial direction by the pressure fluid, which is introduced to the interior of the cylinder tube. A thrust force applied in the axial direction of the piston is converted into an output of the fluid pressure cylinder.

The fluid pressure cylinder includes a spigot joint, which projects toward the side of the cylinder tube, provided on an end of the cylinder cover. The cylinder tube is inserted over an outer circumferential side of the spigot joint, whereby the cylinder tube and the cylinder cover are assembled in a state of being positioned in both axial and radial directions.

SUMMARY OF INVENTION

With the above fluid pressure cylinder, for example, when changes are made to the shape or weight, etc., of a transported workpiece, since the size of the required output of the fluid pressure cylinder also is subject to change, it is necessary to prepare a different type of fluid pressure cylinder with a different output size corresponding to the change in the workpiece, which leads to an increase in equipment costs.

Further, in recent years, from the standpoints of energy conservation and cost reduction, it is desired to use a fluid pressure cylinder that can obtain an ideal output commensurate with the shape and weight, etc., of the workpiece. However, in general, it is difficult to finely set specifications of different bore diameters (cylinder diameters) in a fluid pressure cylinder, and out of necessity, a fluid pressure cylinder, in some cases, must be used, which is equipped with an output capability larger than a desired output. In such cases, the output used to transport the workpiece is excessive, and a surplus amount of pressure fluid ends up being used, and thus the amount of pressure fluid consumed increases beyond the originally intended consumption amount, which runs contrary to trends to reduce energy consumption prevalent in recent years.

A general object of the present invention is to provide a fluid pressure cylinder, which is capable of suppressing equipment costs while enabling the output of the cylinder to be freely changed, together with reducing energy consumption, by easily carrying out a change in the cylinder diameter of the fluid pressure cylinder.

The present invention is characterized by a fluid pressure cylinder comprising a cylindrically shaped cylinder tube having a cylinder chamber in the interior thereof, a pair of cover members mounted on both ends of the cylinder tube, and a piston disposed displaceably along the cylinder chamber, wherein spigot joint means, over which the cylinder tube is inserted, and which positions the cylinder tube in axial and radial directions, are disposed on the cover members, each of the spigot joint means comprising at least two pairs of stepped portions of different diameters or at least two pairs of grooved portions of different diameters, and an inner circumferential surface or an outer circumferential surface of the cylinder tube is selectively installed on any one pair of the stepped portions or on any one pair of the grooved portions.

According to the present invention, in a fluid pressure cylinder on which a pair of cover members are disposed on both ends of the cylindrically shaped cylinder tube having the cylinder chamber in the interior thereof, and in which the piston is disposed displaceably along the cylinder tube, spigot joint means, over which the cylinder tube is inserted, and which are capable of positioning the cylinder tube in axial and radial directions, are disposed on the cover members. In addition, each of the spigot joint means comprises at least two pairs of the stepped portions or the grooved portions of different diameters, and an inner circumferential surface or an outer circumferential surface of the cylinder tube is selectively installed on any one pair of the stepped portions or the grooved portions.

Accordingly, when a cylinder tube is to be exchanged with another cylinder tube having a cylinder chamber of a different diameter, the cylinder tube is removed from one pair of the stepped portions or the grooved portions of the cover members, and the other cylinder tube is installed on another pair of the stepped portions or the grooved portions that differ in diameter, whereby the cylinder tube can easily be exchanged and replaced with the other cylinder tube, which differs in diameter, with respect to the same cover members.

As a result, in the event that the output obtained by the fluid pressure cylinder is to be changed, it becomes possible to change the output using the same cover members of the fluid pressure cylinder, and to obtain a desired output, without any need to prepare a different fluid pressure cylinder equipped with a cylinder tube having a different diameter and a piston having a different diameter and disposed in the interior of the cylinder tube. More specifically, since equipment costs for preparing a new fluid pressure cylinder can be suppressed, together with enabling a fluid pressure cylinder to be constructed in which a cylinder tube can be selected having an optimum diameter (bore diameter) for obtaining a desired output, for example, compared to the case of using a fluid pressure cylinder having an excessive output capability in relation to the desired output, the fluid pressure cylinder can be operated with minimum consumption of pressure fluid, and energy savings can be realized.

The above and other objects, features and advantages of the present invention will become more apparent from the following description when taken in conjunction with the accompanying drawings in which preferred embodiments of the present invention are shown by way of illustrative example.

DESCRIPTION OF EMBODIMENTS

Figure 1:
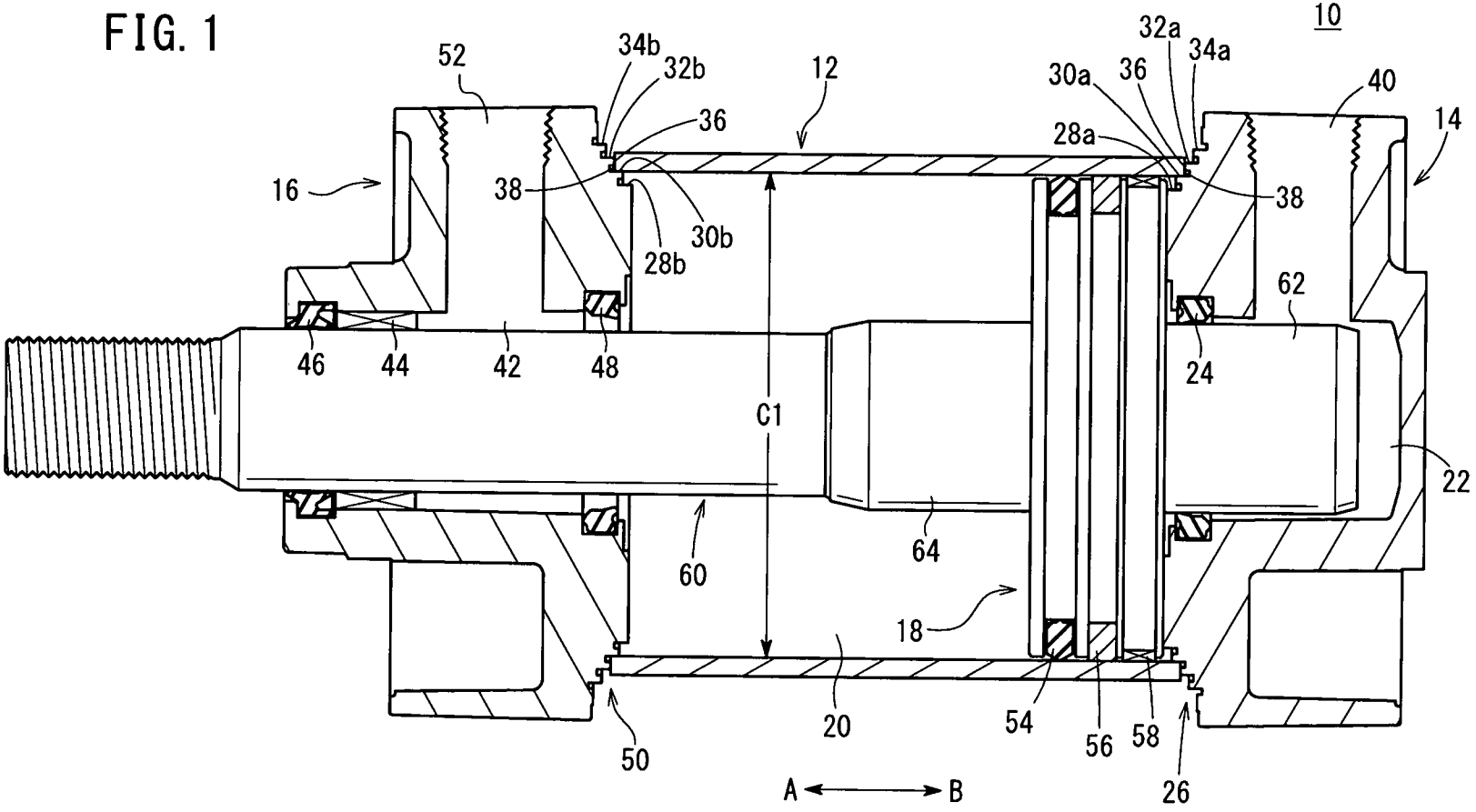
FIG. 1 is an overall cross sectional view of a fluid pressure cylinder according to a first embodiment of the present invention.
Figure 2B:
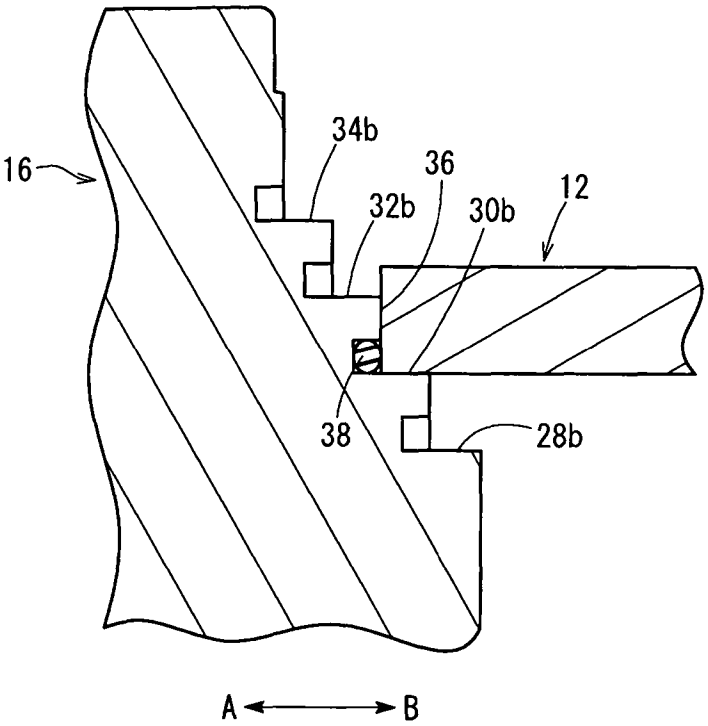
FIG. 2B is an enlarged cross sectional view showing the vicinity of another end side of the cylinder tube shown in FIG. 1.

As shown in FIGS. 1 through 2B, a fluid pressure cylinder 10 includes a cylindrically shaped cylinder tube 12, a head cover (cover member) 14 mounted on one end of the cylinder tube 12, a rod cover (cover member) 16 mounted on another end side of the cylinder tube 12, and a piston 18, which is disposed displaceably in the interior of the cylinder tube 12.

The cylinder tube 12 is made up from a cylindrical body that extends with a substantially constant diameter (cylinder diameter C1) along an axial direction (the direction of arrows A and B). In the interior of the cylinder tube 12, a cylinder chamber 20 in which the piston 18 is accommodated is formed.

The head cover 14, for example, is formed from a metal material with a substantially rectangular shape in cross section, and includes penetrating holes that penetrate in the axial direction (indicated by the arrows A and B) through four corners of the head cover 14. Non-illustrated connecting rods are inserted through the penetrating holes.

In a center portion of the head cover 14, a cavity 22 of a predetermined depth is formed in facing relation to the side of the cylinder tube 12 (in the direction of the arrow A), and a first seal ring 24 is installed in an annular groove formed on an inner circumferential surface of the cavity 22. The cavity 22 is substantially circular in cross section with a substantially constant diameter, and communicates with the cylinder chamber 20 when the head cover 14 is installed on the one end of the cylinder tube 12.

Further, a first spigot joint 26, which projects toward the side of the cylinder tube 12 (in the direction of the arrow A), is formed on one end surface of the head cover 14 on the side of the cylinder tube 12 (in the direction of the arrow A). The first spigot joint 26 is formed in an annular shape on an outer circumferential side of the cavity 22, and is coaxial with the cavity 22.

Figure 2A:
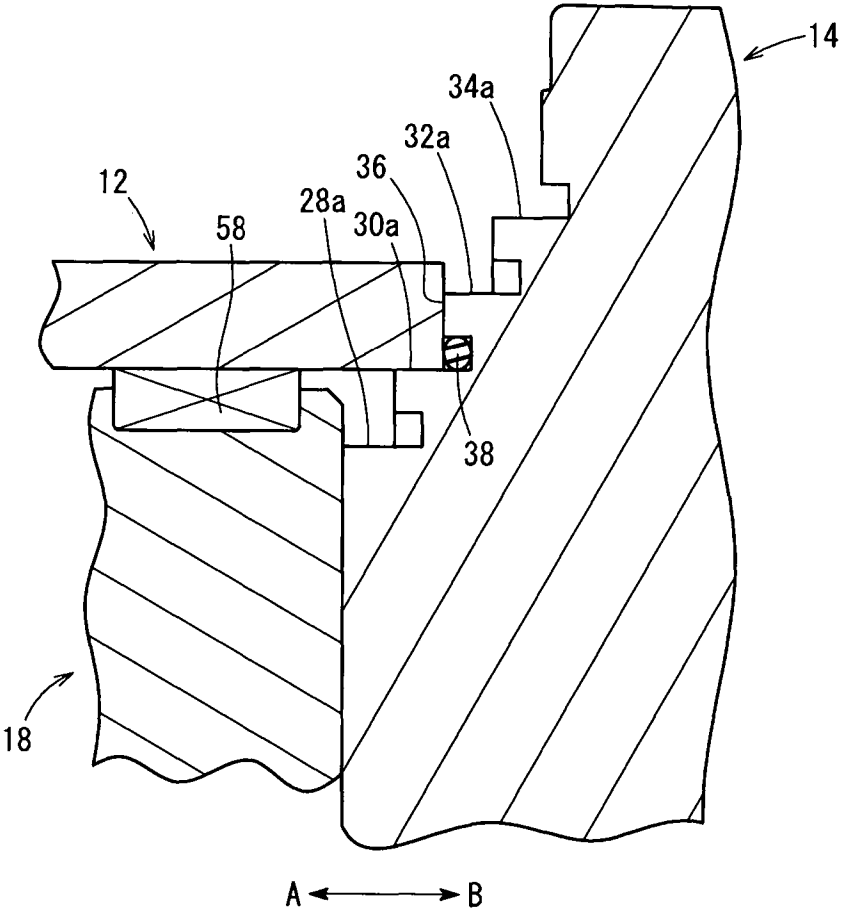
FIG. 2A is an enlarged cross sectional view showing the vicinity of one end side of the cylinder tube shown in FIG. 1.

The first spigot joint 26, for example, as shown in FIGS. 1 and 2A, is formed in a multi-stepped shape made up from first through fourth stepped portions 28*a*, 30*a*, 32*a*, 34*a* that differ in diameter. The first stepped portion 28*a* is the smallest in diameter. The second stepped portion 30*a* is larger in diameter than the first stepped portion 28*a*, and formed on the outer circumferential side of the first stepped portion 28*a*. The third stepped portion 32*a* is larger in diameter than the second stepped portion 30*a*, and formed on the outer circumferential side of the second stepped portion 30*a*. The fourth stepped portion 34*a* is larger in diameter than the third stepped portion 32*a*, and formed on the outer circumferential side of the third stepped portion 32*a*, i.e., on the outermost circumferential side. The first through fourth stepped portions 28*a*, 30*a*, 32*a*, 34*a* are formed in annular shapes, respectively, and are arranged coaxially.

The first stepped portion 28*a* is substantially constant in diameter and projects a predetermined length toward the cylinder tube 12 (in the direction of the arrow A) with respect to the end surface of the head cover 14. The projection length of the stepped portion from the end surface of the head cover 14 is progressively decreased in a stepwise manner in the order of the second stepped portion 30*a*, the third stepped portion 32*a*, and the fourth stepped portion 34*a*.

Stated otherwise, the second through fourth stepped portions 30*a*, 32*a*, 34*a* are formed in an offset manner in axial and radial directions, so as to approach stepwise toward the head cover 14 (in the direction of the arrow B).

Further, O-rings 38 are installed respectively via annular grooves on respective wall portions 36, which are perpendicular to the first through fourth stepped portions 28*a*, 30*a*, 32*a*, 34*a*, and are substantially parallel with the end surface of the head cover 14.

In addition, as shown in FIGS. 1 and 2A, one end of the cylinder tube 12 is inserted over an outer circumferential side of the second stepped portion 30*a* on the head cover 14 in abutment against the wall portion 36, whereby the cylinder tube 12 is positioned axially and radially with respect to the head cover 14. At this time, the one end of the cylinder tube 12 abuts against the O-ring 38 mounted on the wall portion 36, so that leakage of pressure fluid that passes between the cylinder tube 12 and the head cover 14 is prevented from occurring.

On the other hand, on the side surface of the head cover 14, a first fluid port 40 is provided through which the pressure fluid is supplied and discharged, the first fluid port 40 communicating with the cavity 22. In addition, the pressure fluid is introduced into the cavity 22 after the pressure fluid has been supplied to the first fluid port 40 from a non-illustrated pressure fluid supply source.

The rod cover 16, for example, is formed from a metal material with a substantially rectangular shape in cross section, and includes penetrating holes that penetrate in the axial direction through four corners of the rod cover 16. The connecting rods (not shown) are inserted through the penetrating holes. In addition, as shown in FIG. 1, in a condition in which the cylinder tube 12 is mounted between the rod cover 16 and the head cover 14, nuts are screw-engaged onto both ends of the connecting rods that are inserted through the head cover 14 and the rod cover 16. As a result, the cylinder tube 12 is sandwiched and fixed between the head cover 14 and the rod cover 16.

Further, a center portion of the rod cover 16 bulges in a direction away from the cylinder tube 12. In a substantially center portion of the bulge, a rod hole 42 is formed so as to penetrate in the axial direction (the direction of arrows A and B). In addition, a bush 44 and a rod packing 46 are installed on an inner circumferential surface of the rod hole 42. A second seal ring 48 is installed via an annular groove on a side of the rod hole 42 facing the cylinder tube 12. The rod hole 42 communicates with the cylinder chamber 20.

Furthermore, a second spigot joint 50, which projects toward the cylinder tube 12 (in the direction of the arrow B), is formed on one end surface of the rod cover 16 on the side of the cylinder tube 12 (in the direction of the arrow B). The second spigot joint 50 is formed in an annular shape on an outer circumferential side of the rod hole 42, and is coaxial with the rod hole 42.

The second spigot joint 50, for example, as shown in FIGS. 1 and 2B, is formed in a multi-stepped shape made up from first through fourth stepped portions 28*b*, 30*b*, 32*b*, 34*b* that differ in diameter. The first stepped portion 28*b* is the smallest in diameter. The second stepped portion 30*b* is larger in diameter than the first stepped portion 28*b*, and formed on the outer circumferential side of the first stepped portion 28*b*. The third stepped portion 32*b* is larger in diameter than the second stepped portion 30*b*, and formed on the outer circumferential side of the second stepped portion 30*b*. The fourth stepped portion 34*b* is larger in diameter than the third stepped portion 32*b*, and formed on the outer circumferential side of the third stepped portion 32*b*, i.e., on the outermost circumferential side. The first through fourth stepped portions 28*b*, 30*b*, 32*b*, 34*b* are formed in annular shapes, respectively, and are arranged coaxially, while in addition, the first through fourth stepped portions 28*b*, 30*b*, 32*b*, 34*b* are formed with the same diameters, respectively, as the first through fourth stepped portions 28*a*, 30*a*, 32*a*, 34*a*.

The first stepped portion 28*b* is substantially constant in diameter and projects a predetermined length toward the cylinder tube 12 (in the direction of the arrow B) with respect to the end surface of the rod cover 16. The projection length of the stepped portion from the end surface of the rod cover 16 is progressively decreased in a stepwise manner in the order of the second stepped portion 30*b*, the third stepped portion 32*b*, and the fourth stepped portion 34*b*. Stated otherwise, the second through fourth stepped portions 30*b*, 32*b*, 34*b* are formed in an offset manner in axial and radial directions, so as to approach stepwise toward the rod cover 16 (in the direction of the arrow A).

Further, O-rings 38 are installed respectively via annular grooves on respective wall portions 36, which are perpendicular to the first through fourth stepped portions 28*b*, 30*b*, 32*b*, 34*b*, and are substantially parallel with the end surface of the rod cover 16.

In addition, as shown in FIGS. 1 and 2B, the other end of the cylinder tube 12 is inserted over an outer circumferential side of the second stepped portion 30*b* on the rod cover 16 in abutment against the wall portion 36, whereby the cylinder tube 12 is positioned axially and radially with respect to the rod cover 16. At this time, the other end of the cylinder tube 12 abuts against the O-ring 38 mounted on the wall portion 36, so that leakage of pressure fluid that passes between the cylinder tube 12 and the rod cover 16 is prevented from occurring.

More specifically, the first through fourth stepped portions 28*a*, 30*a*, 32*a*, 34*a* of the first spigot joint 26 on the head cover 14, and the first through fourth stepped portions 28*b*, 30*b*, 32*b*, 34*b* of the second spigot joint 50 on the rod cover 16 are disposed in a mutually confronting manner sandwiching the cylinder tube 12 therebetween, whereby both ends of the cylinder tube 12 are retained by the first and second spigot joints 26, 50.

On the other hand, on the side surface of the rod cover 16, a second fluid port 52 is provided through which the pressure fluid is supplied and discharged, the second fluid port 52 communicating with the rod hole 42. In addition, the pressure fluid supplied from the second fluid port 52 is introduced into the cylinder chamber 20 from the rod hole 42.

As shown in FIG. 1, for example, the piston 18 is formed with substantially the same diameter as the cylinder diameter C1 of the cylinder tube 12. A piston packing 54, a magnetic body 56, and a wear ring 58 are installed via a plurality of annular grooves on the outer circumferential surface of the piston 18.

Further, a piston hole (not shown) that penetrates in the axial direction (the direction of arrows A and B) is formed in a center portion of the piston 18. One end of a piston rod 60 is inserted and connected in the piston hole. The one end of the piston rod 60 is connected to the piston 18, whereas the other end of the piston rod 60 is inserted through the rod hole 42 and is supported displaceably by the bush 44.

Further, first and second cushion rings 62, 64 are mounted respectively on both end surfaces of the piston 18. The first and second cushion rings 62, 64 are formed in substantially the same shape. The first cushion ring 62 is arranged on one end side of the piston 18 on the side of the head cover 14 (in the direction of the arrow B), and projects from the one end side. On the other hand, the second cushion ring 64 is arranged on the other end side of the piston 18 on the side of the rod cover 16 (in the direction of the arrow A), and is disposed in covering relation to the outer circumferential surface of the piston rod 60.

In addition, the first and second cushion rings 62, 64 are inserted respectively into the cavity 22 and the rod hole 42 upon displacement of the piston 18 in the axial direction, and by sliding contact of the cushion rings 62, 64 with the first and second seal rings 24, 48, the displacement velocity of the piston 18 is reduced.

The fluid pressure cylinder 10 according to the first embodiment of the present invention is constructed basically as described above. Next, operations and advantageous effects of the fluid pressure cylinder will be described. The condition shown in FIG. 1, in which the piston 18 is displaced toward the side of the head cover 14 (in the direction of the arrow B), and the first cushion ring 62 is accommodated in the cavity 22, will be referred to as an initial condition.

Initially, a pressure fluid from a non-illustrated pressure fluid supply source is introduced to the first fluid port 40. In this case, the second fluid port 52 is placed in a state of being open to atmosphere under a switching action of a non-illustrated switching valve. Consequently, the pressure fluid is supplied into the cavity 22 from the first fluid port 40, and by means of the pressure fluid, which is introduced into the cylinder chamber 20 from the cavity 22, the piston 18 is pressed toward the rod cover 16 (in the direction of the arrow A). In addition, the piston rod 60 also is displaced due to displacement of the piston 18, and the first cushion ring 62 mounted on the end of the piston rod 60 separates away from the cavity 22 while in sliding contact with the first seal ring 24.

Next, upon further displacement of the piston 18, the second cushion ring 64 is inserted into the rod hole 42, whereby the flow rate of the pressure fluid is restricted and is compressed at the interior of the cylinder chamber 20. As a result, displacement resistance is created when the piston 18 is displaced, and the displacement velocity of the piston 18 decreases gradually as the piston 18 approaches the displacement end position thereof.

Lastly, the piston 18 gradually is displaced toward the rod cover 16 (in the direction of the arrow A), whereupon the second cushion ring 64 becomes accommodated completely in the rod hole 42, and the displacement end position is reached, in which the piston 18 reaches the rod cover 16 (in the direction of the arrow A).

On the other hand, in the case that the piston 18 is displaced in the opposite direction (in the direction of the arrow B), pressure fluid is supplied to the second fluid port 52, and the first fluid port 40 is placed in a state of being open to atmosphere under a switching action of a non-illustrated switching valve. In addition, the pressure fluid is supplied into the rod hole 42 from the second fluid port 52, and by means of the pressure fluid, which is introduced into the cylinder chamber 20 from the rod hole 42, the piston 18 is pressed toward the head cover 14 (in the direction of the arrow B).

In addition, the piston rod 60 also is displaced due to displacement of the piston 18, and the second cushion ring 64 mounted on the end of the piston rod 60 separates away from the rod hole 42 while in sliding contact with the second seal ring 48.

Next, upon further displacement of the piston 18, the first cushion ring 62 is inserted into the cavity 22, whereby the flow rate of the pressure fluid is restricted and is compressed at the interior of the cylinder chamber 20. As a result, displacement resistance is created when the piston 18 is displaced, and the displacement velocity of the piston 18 decreases gradually. Additionally, by abutment of the piston 18 against the head cover 14, the initial position is restored (see FIG. 1).

Next, a situation will be explained in which, in order to change the output of the aforementioned fluid pressure cylinder 10, the cylinder tube 12 and the piston 18 are exchanged and replaced with a different cylinder tube 12 and piston 18, to thereby change the bore diameter (cylinder diameter). In particular, a case will be described in which the output is increased by enlarging the bore diameter.

At first, non-illustrated nuts, which are screw-engaged with the connecting rods, are loosened, thereby releasing the state of connection of the head cover 14 and the rod cover 16 with the cylinder tube 12 therebetween. Thereafter, the head cover 14 and the rod cover 16 are separated mutually in axial directions (the directions of arrows A and B) away from the cylinder tube 12.

Figure 3:
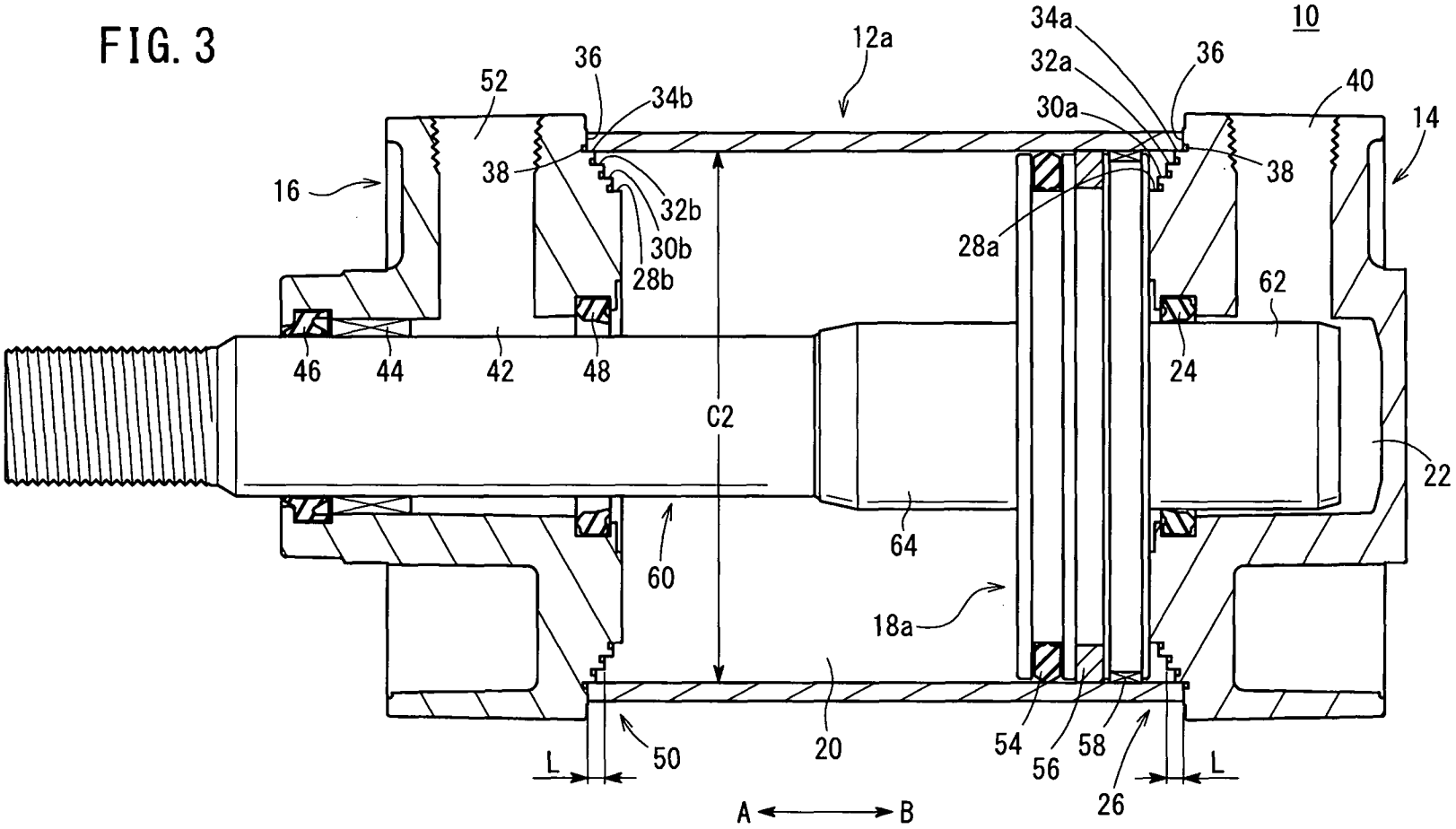
FIG. 3 is an overall cross sectional view showing a condition in which a new cylinder tube having a different diameter is exchanged in the fluid pressure cylinder of FIG. 1.

Next, as shown in FIG. 3, a new cylinder tube 12*a* having a larger cylinder diameter C2 than that of the aforementioned cylinder tube 12, and a new piston 18*a* formed with substantially the same diameter as the cylinder diameter C2 are prepared. In this case, the length in the axial direction (the direction of arrows A and B) of the new cylinder tube 12*a* is longer than the length of the cylinder tube 12 by a difference (refer to L in FIG. 3) equivalent to the length in the axial direction between the fourth stepped portion 34*a* and the second stepped portion 30*a* on the head cover 14 and the length in the axial direction between the fourth stepped portion 34*b* and the second stepped portion 30*b* on the rod cover 16. More specifically, the lengths in the axial direction of the cylinder tubes are set such that the distance between the head cover 14 and the rod cover 16 in the axial direction is not subject to change.

Further, O-rings 38 are installed, respectively, via annular grooves on the wall portions 36 that face the fourth stepped portions 34*a*, 34*b* on which the cylinder tube 12*a* is installed.

In addition, one end of the cylinder tube 12*a* is inserted over the outer circumference of the fourth stepped portion 34*a* on the head cover 14, whereby the one end of the cylinder tube 12*a* is retained with respect to the head cover 14. Further, in a state in which the piston 18*a*, which has a larger diameter corresponding to the inner circumferential diameter of the cylinder tube 12*a*, is inserted through the interior of the cylinder tube 12*a*, the other end of the cylinder tube 12*a* is inserted over the outer circumference of the fourth stepped portion 34*b* on the rod cover 16. Consequently, a state is brought about in which the other end of the cylinder tube 12*a* is mounted on the rod cover 16, and both ends of the cylinder tube 12*a* abut respectively against the O-rings 38.

In this state, the connecting rods (not shown) are inserted through the head cover 14 and the rod cover 16, and by screw-engagement and fastening of nuts on both ends of the connecting rods, the head cover 14 and the rod cover 16 are connected with the cylinder tube 12*a* gripped therebetween.

Consequently, in the fluid pressure cylinder 10, the cylinder tube 12 and the piston 18 thereof are replaced by a cylinder tube 12*a* having a larger cylinder diameter C2 and a piston 18*a* having a larger diameter corresponding to the cylinder diameter C2, and under a displacement action of the piston 18*a*, the output force, which is output in the axial direction from the piston rod 60, is made larger. In this manner, for example, in the case that the output is increased according to the weight, etc., of the transported workpiece, by exchanging and replacing the cylinder tube 12 and the piston 18 with a cylinder tube 12*a* having a larger cylinder diameter and a piston 18*a* having a diameter corresponding to the larger cylinder diameter, an optimal output corresponding to the workpiece can be obtained.

On the other hand, in the case that the bore diameter in the fluid pressure cylinder 10 is to be reduced, a cylinder tube 12 having a smaller cylinder diameter, and a piston having a diameter corresponding to the smaller cylinder diameter are prepared and assembled, whereby the output of the fluid pressure cylinder 10 can easily be decreased. Along therewith, the consumption amount of pressure fluid used in the fluid pressure cylinder 10 can be reduced, and as a result, energy savings in the fluid pressure cylinder 10 can be realized.

Stated otherwise, in the fluid pressure cylinder 10, by exchanging cylinder tubes 12 equipped with various different cylinder diameters, as well as changing pistons 18 corresponding to the cylinder diameters of such cylinder tubes 12, the output of the fluid pressure cylinder 10 can easily be changed, while the same head cover 14 and rod cover 16 can be used in common.

Moreover, with the above fluid pressure cylinder 10, a structure has been described in which four stepped portions 28*a*, 28*b*, 30*a*, 30*b*, 32*a*, 32*b*, 34*a*, 34*b* are provided on each of the first and second spigot joints 26, 50. However, the invention is not limited to this feature, and insofar as the number of the stepped portions on the first spigot joint 26 agrees with the number of the stepped portions on the second spigot joint 50 while the diameters of the stepped portions on the first spigot joint 26 correspond respectively to the diameters of the stepped portions on the second spigot joint 50, the actual number thereof is not particularly limited.

In the foregoing manner, according to the first embodiment, first through fourth stepped portions 28*a*, 30*a*, 32*a*, 34*a* that differ in diameter are disposed on the first spigot joint 26 of the head cover 14, first through fourth stepped portions 28*b*, 30*b*, 32*b*, 34*b* that differ in diameter are disposed on the second spigot joint 50 of the rod cover 16, and the cylinder tube 12 is mounted selectively on any one pair of the first through fourth stepped portions 28*a*, 28*b*, 30*a*, 30*b*, 32*a*, 32*b*, 34*a*, 34*b*, whereby the cylinder tube 12 can be positioned in the axial direction and retained coaxially with respect to the head cover 14 and the rod cover 16. Owing thereto, by exchanging and replacing the cylinder tube 12 with a new cylinder tube 12*a* having a different cylinder diameter, together with a new piston 18*a* having a diameter corresponding to the different cylinder diameter, a fluid pressure cylinder 10 having a different bore diameter (cylinder diameter) can easily be constructed while making use of the same head cover 14 and rod cover 16.

As a result, in the case that the output obtained by the fluid pressure cylinder 10 is to be changed, it is possible to change the output using the same head cover 14 and the same rod cover 16 of the fluid pressure cylinder 10, and thereby obtain a desired output without any need to prepare another fluid pressure cylinder 10 equipped with a piston 18 having a different diameter and a cylinder tube 12 having a different diameter.

More specifically, equipment costs for preparing a new fluid pressure cylinder can be suppressed, together with enabling a fluid pressure cylinder 10 to be constructed in which the cylinder tube 12 and the piston 18 can be selected to have an optimum diameter (bore diameter) for obtaining a desired output. Owing thereto, for example, compared to the case of using a fluid pressure cylinder having an excessive output capability in relation to the desired output, the fluid pressure cylinder 10 can be operated with minimum consumption of pressure fluid, and accordingly energy savings can be realized.

Further, even in the case that a cylinder tube and a piston are exchanged by a cylinder tube 12*a* of a different cylinder diameter and a piston 18*a* corresponding to the cylinder diameter, and the cylinder diameter (C1, C2) of the cylinder chamber 20 in the fluid pressure cylinder 10 is changed, by using a new cylinder tube 12*a* having a length depending on the difference in the axial direction of the first through fourth stepped portions 28*a*, 28*b*, 30*a*, 30*b*, 32*a*, 32*b*, 34*a*, 34*b*, the length dimension of the fluid pressure cylinder 10 is not subject to change.

Owing thereto, for example, in the case that the fluid pressure cylinder 10 is used on an assembly line, and is attached to the assembly line via the head cover 14 and the rod cover 16, the fluid pressure cylinder can be mounted reliably at the prior attachment position without changes to the attachment position (attachment pitch) thereof. As a result, the bore diameter of a fluid pressure cylinder 10, which is used on an assembly line, can easily be changed, and the fluid pressure cylinder 10 can easily and reliably be installed with respect to the assembly line.

Furthermore, on the first and second spigot joints 26, 50, O-rings 38 are disposed detachably via annular grooves on respective wall portions 36, which are perpendicular to the axial direction of the fluid pressure cylinder 10 and formed respectively corresponding to the first through fourth stepped portions 28*a*, 28*b*, 30*a*, 30*b*, 32*a*, 32*b*, 34*a*, 34*b*. Accordingly, by installing the O-rings 38 on the wall portions 36 corresponding to the stepped portions on which the cylinder tube 12 is mounted, ends of the cylinder tube 12 can be placed in abutment against the O-rings 38. As a result, by the O-rings 38, leakage of pressure fluid that passes between the cylinder tube 12, the head cover 14, and the rod cover 16 can be reliably prevented from occurring.

Figure 4:
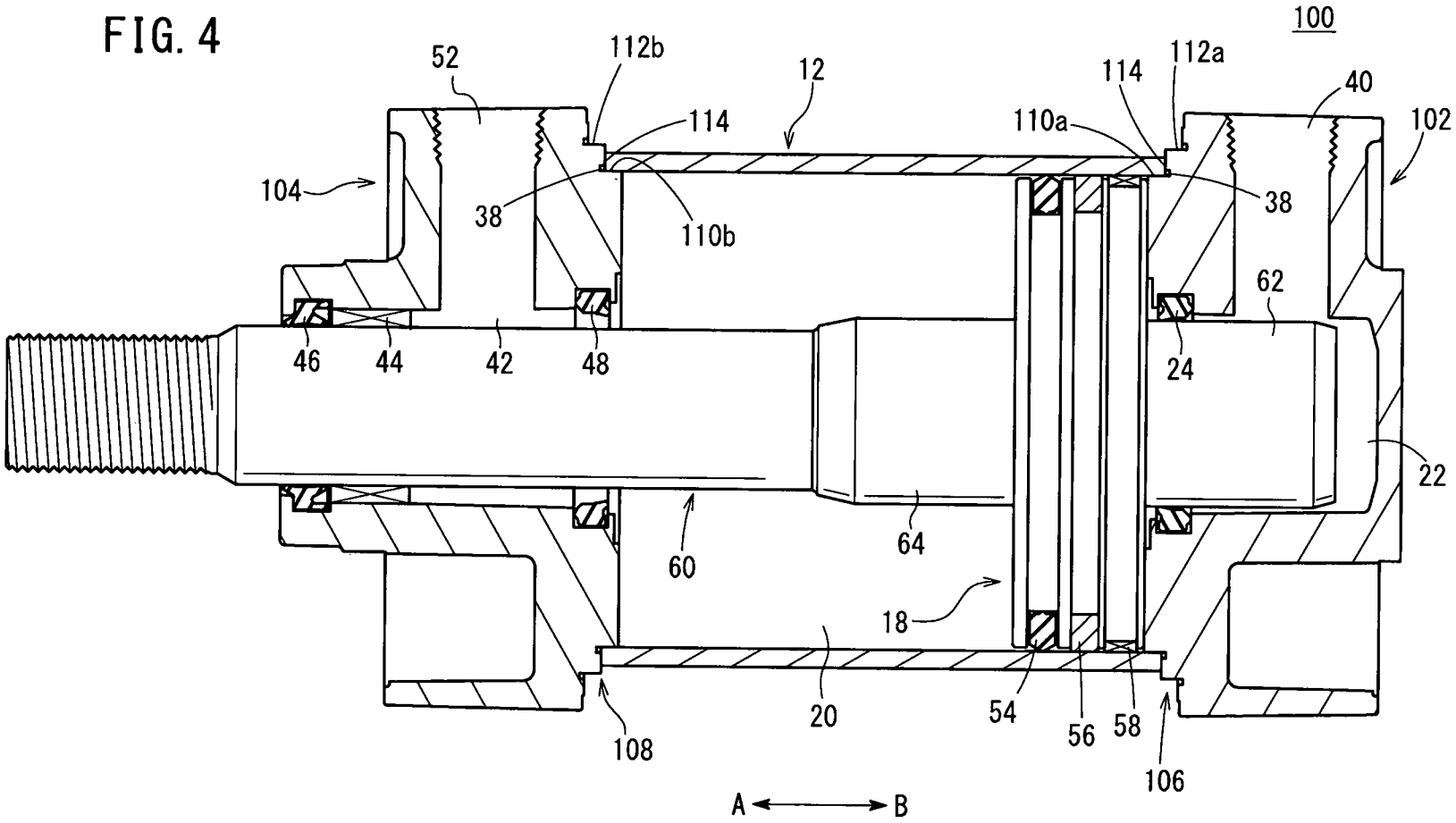
FIG. 4 is an overall cross sectional view of a fluid pressure cylinder according to a second embodiment of the present invention.

Next, a fluid pressure cylinder 100 according to a second embodiment is shown in FIG. 4. Constituent elements of the fluid pressure cylinder 100, which are the same as those of the fluid pressure cylinder 10 according to the first embodiment, are denoted using the same reference numerals, and detailed description of such features is omitted.

As shown in FIG. 4, the fluid pressure cylinder 100 differs from the fluid pressure cylinder 10 according to the first embodiment, in that each of first and second spigot joints 106, 108 provided respectively on a head cover 102 and a rod cover 104 is constituted from two stepped portions, i.e., fifth and sixth stepped portions 110*a*, 112*a* for the first spigot joint 106, and fifth and sixth stepped portions 110*b*, 112*b* for the second spigot joint 108.

Concerning the fifth and sixth stepped portions 110*a*, 110*b*, 112*a*, 112*b* provided on the head cover 102 and the rod cover 104, the fifth stepped portions 110*a*, 110*b* are formed respectively on inner circumferential sides of the head cover 102 and the rod cover 104, whereas the sixth stepped portions 112*a*, 112*b* are formed respectively on outer circumferential sides of the head cover 102 and the rod cover 104. Together therewith, concerning the lengths at which the stepped portions project with respect to end surfaces of the head cover 102 and the rod cover 104, the fifth stepped portions 110*a*, 110*b* are formed to project at a greater length than the sixth stepped portions 112*a*, 112*b*.

Further, for example, the diameter of the fifth stepped portions 110*a*, 110*b* is set to the same diameter as the second stepped portions 30*a*, 30*b* in the fluid pressure cylinder 10 of the aforementioned first embodiment, and the diameter of the sixth stepped portions 112*a*, 112*b* is set to the same diameter as the fourth stepped portions 34*a*, 34*b* in the fluid pressure cylinder 10. More specifically, a construction is made up in which stepped portions are provided corresponding to the second and fourth stepped portions 30*a*, 30*b*, 34*a*, 34*b* of the fluid pressure cylinder 10, whereas the stepped portions 32*a*, 32*b* of intermediate diameters between the second and fourth stepped portions 30*a*, 30*b*, 34*a*, 34*b* are not provided.

Furthermore, on the head cover 102 and the rod cover 104, wall portions 114 are formed perpendicularly to the fifth and sixth stepped portions 110*a*, 110*b*, 112*a*, 112*b*, and substantially in parallel to end surfaces of the head cover 102 and the rod cover 104. O-rings 38 are installed via annular grooves respectively on the wall portions 114. Moreover, compared to the respective wall portions 36 of the fluid pressure cylinder 10 according to the first embodiment, the area of the wall portions 114 can be assured to be greater by an area occupied by the reduced number of stepped portions. More specifically, the area of the wall portions 114 can be increased in the radial direction.

In addition, for example, one end of the cylinder tube 12 is inserted over the outer circumferential side of the fifth stepped portion 110*a* on the head cover 102, and the other end of the cylinder tube 12 is inserted over the outer circumferential side of the fifth stepped portion 110*b* on the rod cover 104, and by the ends coming into abutment against the respective wall portions 114, the cylinder tube 12 is retained in a positioned state radially and axially (in the direction of arrows A and B) with respect to the head cover 102 and the rod cover 104. At this time, both ends of the cylinder tube 12 come into abutment against the O-rings 38 that are installed on the wall portions 114, whereby leakage of pressure fluid that passes between the cylinder tube 12, the head cover 102, and the rod cover 104 is prevented from occurring.

Operations of the fluid pressure cylinder 100 and the operation by which the bore diameter is changed are the same as those carried out with the fluid pressure cylinder 10 according to the first embodiment, and thus, description of such details is omitted.

In the foregoing manner, according to the second embodiment, fifth and sixth stepped portions 110*a*, 112*a* that differ in diameter are disposed on the first spigot joint 106 of the head cover 102, fifth and sixth stepped portions 110*b*, 112*b* that differ in diameter are disposed on the second spigot joint 108 of the rod cover 104, and the cylinder tube 12 is mounted selectively on any one pair of the fifth and sixth stepped portions 110*a*, 110*b*, 112*a*, 112*b*, whereby the cylinder tube 12 can be positioned in the axial direction (the direction of arrows A and B) and retained coaxially with the head cover 102 and the rod cover 104.

Owing thereto, by exchanging and replacing the cylinder tube 12 and the piston 18 with a new cylinder tube 12 having a different cylinder diameter and a new piston 18 having a diameter corresponding to the different cylinder diameter, a fluid pressure cylinder 100 having a different bore diameter (cylinder diameter) can easily be constructed while making use of the same head cover 102 and rod cover 104.

As a result, in the case that the output obtained by the fluid pressure cylinder 100 is to be changed, it is possible to change the output using the same head cover 102 and rod cover 104 of the fluid pressure cylinder 100, and thereby to obtain a desired output, without any need to prepare another fluid pressure cylinder equipped with a piston 18 having a different diameter and a cylinder tube 12 having a different diameter.

More specifically, equipment costs for preparing a new fluid pressure cylinder can be suppressed, together with enabling a fluid pressure cylinder 100 to be constructed in which the cylinder tube 12 and the piston 18 can be selected to have an optimum diameter (bore diameter) for obtaining a desired output. Owing thereto, for example, compared to the case of using a fluid pressure cylinder having an excessive output capability in relation to the desired output, the fluid pressure cylinder 100 can be operated with minimum consumption of pressure fluid, and energy savings can be realized accordingly.

Further, compared to the fluid pressure cylinder 10 according to the first embodiment, since a fewer number of stepped portions are provided on the first and second spigot joints 106, 108, a large area for the wall portions 114 that abut against both ends of the cylinder tube 12 can be assured. As a result, both ends of the cylinder tube 12 are placed in abutment more reliably against the head cover 102 and the rod cover 104, and positioning of the cylinder tube 12 can be performed with higher precision in the axial direction (the direction of arrows A and B).

Figure 5A:
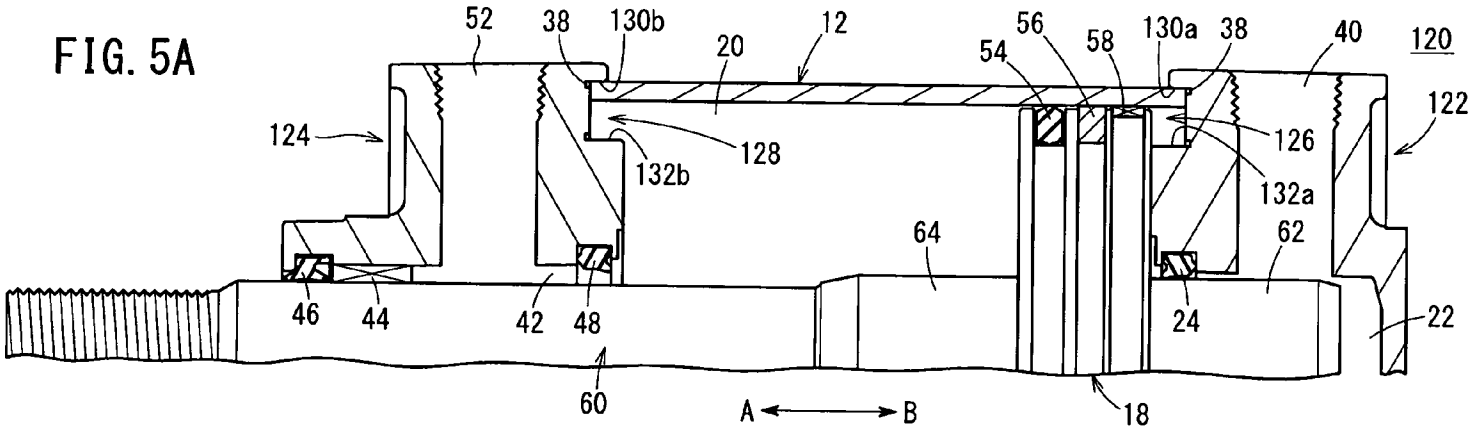
FIG. 5A is a partial cross sectional view showing a portion of a fluid pressure cylinder according to a third embodiment of the present invention.
Figure 5B:
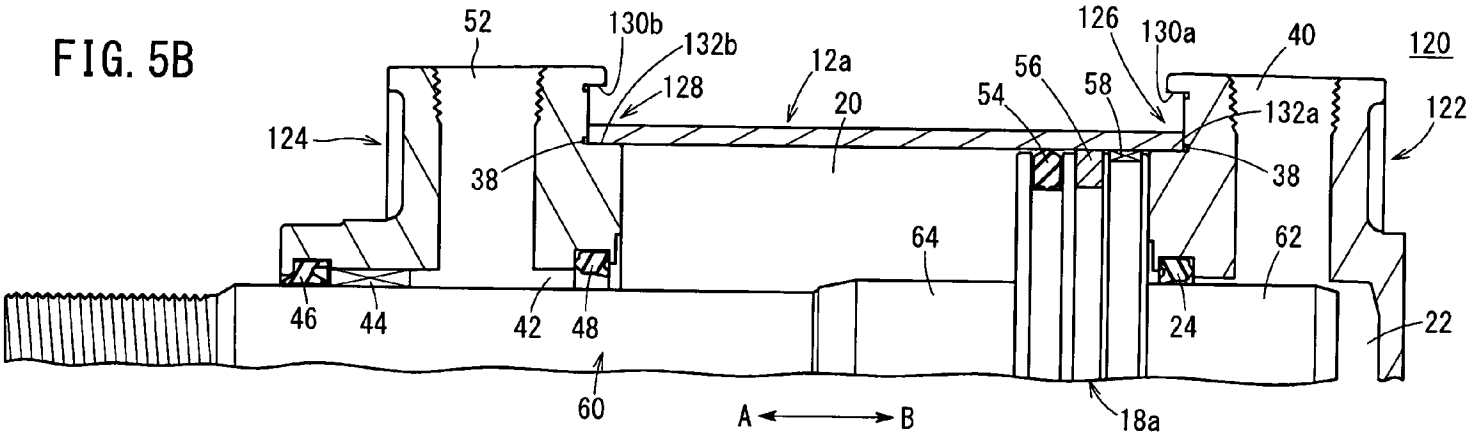
FIG. 5B is a partial cross sectional view showing a condition in which a new cylinder tube having a different diameter is exchanged in the fluid pressure cylinder of FIG. 5A.

Next, a fluid pressure cylinder 120 according to a third embodiment is shown in FIGS. 5A and 5B. Constituent elements of the fluid pressure cylinder 120, which are the same as those of the fluid pressure cylinders 10, 100 according to the first and second embodiments, are denoted using the same reference numerals, and detailed description of such features is omitted.

As shown in FIGS. 5A and 5B, the fluid pressure cylinder 120 differs from the fluid pressure cylinders 10, 100 according to the first and second embodiments, in that first and second spigot joints 126, 128, which have an annularly-recessed shape, are formed respectively on end surfaces of a head cover 122 and a rod cover 124.

The first spigot joint 126 is recessed in the axial direction (the direction of the arrow B) at a predetermined depth from an end face of the head cover 122 that faces toward the cylinder tube 12, and is formed coaxially with the cavity 22.

Further, the first spigot joint 126 is equipped with a first spigot surface 130*a* formed on an outer circumferential side in the first spigot joint 126, and a second spigot surface 132*a* formed on an inner circumferential side therein. The first and second spigot surfaces 130*a*, 132*a* are formed mutually in parallel with each other, and parallel with the axial direction of the head cover 122. More specifically, the second spigot surface 132*a* is disposed on a central side of the head cover 122. A distance in the radial direction between the first spigot surface 130*a* and the second spigot surface 132*a* is set to be greater than a thickness of the cylinder tube 12 in the radial direction.

Furthermore, O-rings 38 are installed via annular grooves, respectively, on wall portions adjacent to the first and second spigot surfaces 130*a*, 132*a* in the first spigot joint 126. A fluidtight state is maintained by abutment of one end of the cylinder tube 12 against the O-ring 38 when the one end of the cylinder tube 12 is installed with respect to the first spigot joint 126.

In addition, positioning of the cylinder tube 12 in the radial direction is carried out by placing the outer circumferential surface of the cylinder tube 12 in abutment with the first spigot surface 130*a* in the first spigot joint 126 or placing the inner circumferential surface of the cylinder tube 12 in abutment with the second spigot surface 132*a* in the first spigot joint 126.

On the other hand, the second spigot joint 128 is recessed in the axial direction (the direction of the arrow A) at a predetermined depth from an end face of the rod cover 124 that faces toward the cylinder tube 12, and is formed coaxially with the rod hole 42.

Further, as with the first spigot joint 126, the second spigot joint 128 is equipped with a first spigot surface 130*b* formed on an outer circumferential side in the second spigot joint 128, and a second spigot surface 132*b* formed on an inner circumferential side therein. The first and second spigot surfaces 130*b*, 132*b* are formed mutually in parallel with each other, and parallel with the axial direction of the rod cover 124. More specifically, the second spigot surface 132*b* is disposed on a central side of the rod cover 124. A distance in the radial direction between the first spigot surface 130*b* and the second spigot surface 132*b* is set to be greater than a thickness of the cylinder tube 12 in the radial direction.

Furthermore, O-rings 38 are installed via annular grooves, respectively, on wall portions adjacent to the first and second spigot surfaces 130*b*, 132*b* in the second spigot joint 128. A fluidtight state is maintained by abutment of the other end of the cylinder tube 12 against the O-ring 38 when the other end of the cylinder tube 12 is installed with respect to the second spigot joint 128.

In addition, positioning of the cylinder tube 12 in the radial direction is carried out by placing the outer circumferential surface of the cylinder tube 12 in abutment with the first spigot surface 130*b* in the second spigot joint 128 or placing the inner circumferential surface of the cylinder tube 12 in abutment with the second spigot surface 132*b* in the second spigot joint 128.

With the fluid pressure cylinder 120 shown in FIG. 5A, for example, the one end and the other end of the cylinder tube 12 abut, respectively, against the first spigot surfaces 130*a*, 130*b* that are provided on outer circumferential sides of the first and second spigot joints 126, 128, whereby the cylinder tube 12 is positioned in the radial direction. Further, by abutment of the one end and the other end of the cylinder tube 12 against the wall portions of the first and second spigot joints 126, 128, the cylinder tube 12 is positioned and retained in the axial direction (the direction of arrows A and B).

In addition, in the case that the cylinder tube 12 is replaced with a new cylinder tube 12*a* having a smaller diameter, as shown in FIG. 5B, the inner circumferential surface of the one end of the cylinder tube 12*a* is placed in abutment against the second spigot surface 132*a* of the first spigot joint 126 and is positioned radially. Together therewith, the piston 18*a*, which corresponds with the diameter of the cylinder tube 12*a*, is inserted through the interior of the cylinder tube 12*a*. In this condition, the other end of the cylinder tube 12*a* is inserted into the second spigot joint 128 of the rod cover 124, and after being placed in abutment with the second spigot surface 132*b*, is moved into abutment against the wall portion.

Consequently, by the second spigot surfaces 132*a*, 132*b*, the cylinder tube 12*a* is positioned and retained axially (in the direction of arrows A and B) and radially with respect to the head cover 122 and the rod cover 124. At this time, both ends of the cylinder tube 12*a* come into abutment against the O-rings 38 installed on the wall portions, whereby leakage of pressure fluid that passes between the cylinder tube 12*a*, the head cover 122, and the rod cover 124 is prevented from occurring.

In the foregoing manner, with the third embodiment, the first and second spigot joints 126, 128, which are annularly recessed, and have sizes of the recesses in a radial direction greater than the thickness of the cylinder tube 12 in the radial direction, are provided respectively on end surfaces of the head cover 122 and the rod cover 124, whereby positioning of the cylinder tube 12 in the radial direction can be carried out using either one pair of the first spigot surfaces 130*a*, 130*b* on the outer circumferential side of the first and second spigot joints 126, 128, and the second spigot surfaces 132*a*, 132*b* on the inner circumferential side of the first and second spigot joints 126, 128.

Owing thereto, positioning of the cylinder tubes 12, 12*a* having different diameters can be carried out by a single spigot portion provided on each of the head cover 122 and the rod cover 124, i.e., the first and second spigot joints 126, 128. As a result, compared to a situation in which plural spigot portions are disposed on each of the head cover 122 and the rod cover 124 for carrying out positioning of the different diameter cylinder tubes 12, 12*a*, since positioning thereof can be handled by means of the single spigot portion, i.e., the first and second spigot joints 126, 128, manufacturing costs for the fluid pressure cylinder 120 can be reduced.

Figure 6A:
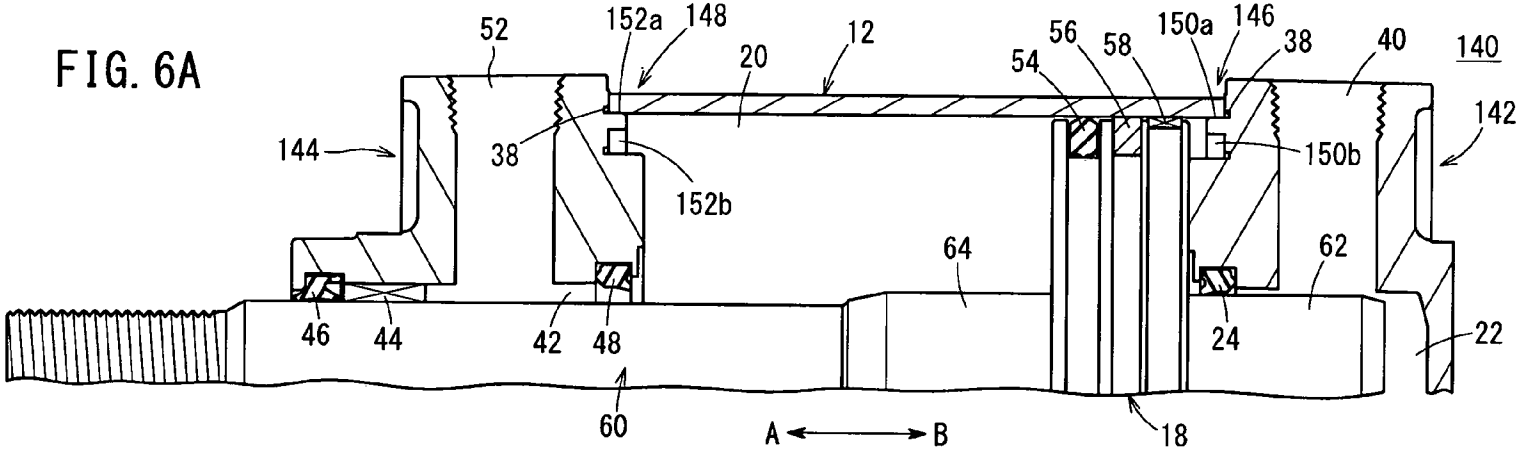
FIG. 6A is a partial cross sectional view showing a portion of a fluid pressure cylinder according to a fourth embodiment of the present invention.
Figure 6B:
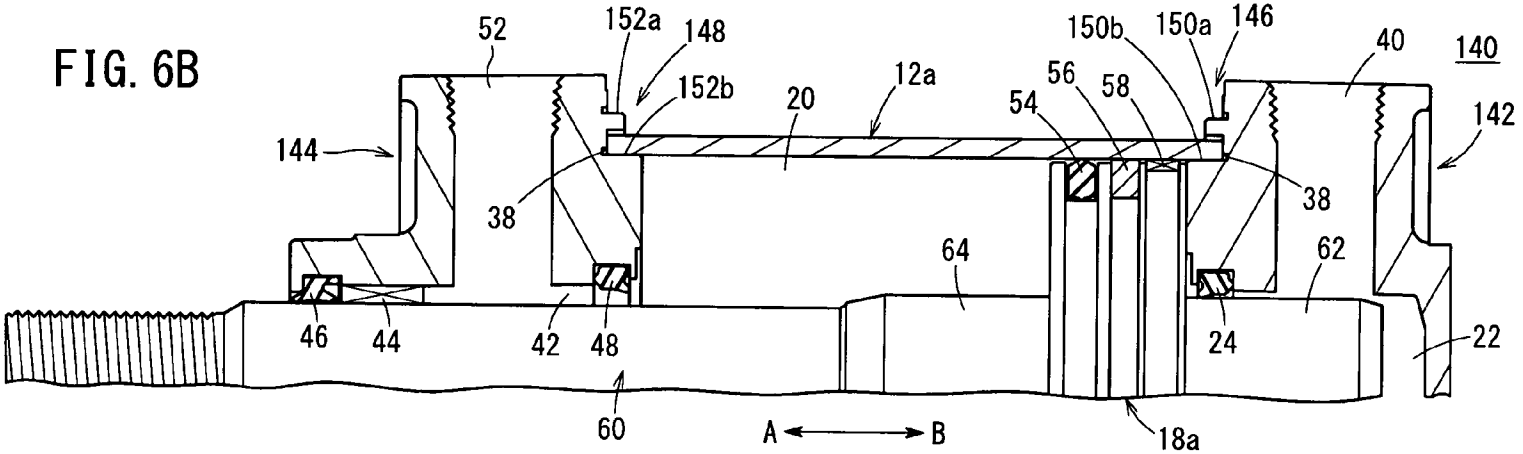
FIG. 6B is a partial cross sectional view showing a condition in which a new cylinder tube having a different diameter is exchanged in the fluid pressure cylinder of FIG. 6A.

Next, a fluid pressure cylinder 140 according to a fourth embodiment is shown in FIGS. 6A and 6B. Constituent elements of the fluid pressure cylinder 140, which are the same as those of the fluid pressure cylinders 10, 100, 120 according to the first through third embodiments, are denoted using the same reference numerals, and detailed description of such features is omitted.

As shown in FIGS. 6A and 6B, the fluid pressure cylinder 140 differs from the fluid pressure cylinders 10, 100, 120 according to the first through third embodiments, in that first and second spigot joints 146, 148, each having plural spigots, are formed respectively on end surfaces of a head cover 142 and a rod cover 144.

The first spigot joint 146, for example, is recessed in the axial direction (the direction of the arrow B) at a predetermined depth from an end surface of the head cover 142 facing toward the cylinder tube 12, and includes a plurality of (e.g., two) first spigots 150*a*, 150*b*, which are separated by a predetermined distance in the radial direction. The first spigots 150*a*, 150*b* are formed in annular shapes and coaxially with the cavity 22. One of the first spigots 150*a* disposed on the outer circumferential side is formed so as to be exposed to the exterior, whereas the other first spigot 150*b* disposed on the inner circumferential side is formed into an annular grooved portion.

Further, O-rings 38 are installed via annular grooves, respectively, on wall portions adjacent to the first spigots 150*a*, 150*b*, and a fluidtight state is maintained by abutment of one end of the cylinder tube 12 against the O-ring 38 when the one end of the cylinder tube 12 is installed.

In addition, positioning of the cylinder tube in the radial direction is carried out by inserting the one end of the cylinder tube 12 over either one of the first spigots 150*a*, 150*b* on the first spigot joint 146, and placing the inner circumferential surface of the cylinder tube 12 in abutment against the outer circumferential surface of the one of the first spigots 150*a*, 150*b*. More specifically, the first spigots 150*a*, 150*b* on the first spigot joint 146 serve as spigot surfaces, which carry out positioning of the cylinder tube 12 in the radial direction.

On the other hand, the second spigot joint 148, for example, is recessed in the axial direction (the direction of the arrow A) at a predetermined depth from an end surface of the rod cover 144 facing toward the cylinder tube 12, and includes a plurality of (e.g., two) second spigots 152*a*, 152*b*, which are separated by a predetermined distance in the radial direction. The second spigots 152*a*, 152*b* are formed in annular shapes and coaxially with the rod hole 42. One of the second spigots 152*a* disposed on the outer circumferential side is formed so as to be exposed to the exterior, whereas the other second spigot 152*b* disposed on the inner circumferential side is formed into an annular grooved portion.

Further, O-rings 38 are installed via annular grooves, respectively, on wall portions adjacent to the second spigots 152*a*, 152*b*, and a fluidtight state is maintained by abutment of the other end of the cylinder tube 12 against the O-ring 38 when the other end of the cylinder tube 12 is installed.

In addition, positioning of the cylinder tube in the radial direction is carried out by inserting the other end of the cylinder tube 12 over either one of the second spigots 152*a*, 152*b* on the second spigot joint 148, and placing the inner circumferential surface of the cylinder tube 12 in abutment against the outer circumferential surface of the one of the second spigots 152*a*, 152*b*. More specifically, the second spigots 152*a*, 152*b* on the second spigot joint 148 serve as spigot surfaces, which carry out positioning of the cylinder tube 12 in the radial direction.

For example, with the fluid pressure cylinder 140 shown in FIG. 6A, the one end and the other end of the cylinder tube 12 are mounted respectively on the first and second spigots 150*a*, 152*a*, which are disposed on outer circumferential sides of the first and second spigot joints 146, 148 and thereby positioned in the radial direction. In addition, by abutment of the one end and the other end of the cylinder tube 12 against the wall portions of the first and second spigot joints 146, 148, the cylinder tube 12 is positioned and retained in the axial direction.

In addition, in the case that the above-mentioned cylinder tube 12 is to be replaced with a new cylinder tube 12*a* having a smaller diameter, as shown in FIG. 6B, the one end of the cylinder tube 12*a* is inserted over the first spigot 150*b* on the inner circumferential side of the first spigot joint 146, and the inner circumferential surface of the cylinder tube 12*a* is placed in abutment against the outer circumferential surface of the first spigot 150*b*, thereby positioning the cylinder tube 12*a* radially. Thereafter, in a state in which a piston 18*a*, which has a smaller diameter corresponding to the diameter of the cylinder tube 12*a*, is inserted into the cylinder tube 12*a*, the other end of the cylinder tube 12*a* is inserted over the second spigot 152*b* on the inner circumferential side of the second spigot joint 148 on the rod cover 144, such that the cylinder tube 12*a* abuts against the outer circumferential surface of the second spigot 152*b* and is made to abut against the wall portion.

Consequently, by the first and second spigots 150*b*, 152*b* provided on the inner circumferential side, the cylinder tube 12*a* is positioned and retained axially (in the direction of arrows A and B) and radially with respect to the head cover 142 and the rod cover 144. At this time, both ends of the cylinder tube 12*a* come into abutment against the O-rings 38 installed on the wall portions, whereby leakage of pressure fluid that passes between the cylinder tube 12*a*, the head cover 142, and the rod cover 144 is prevented from occurring.

In the foregoing manner, with the fourth embodiment, on ends of the head cover 142 and the rod cover 144, the first and second spigot joints 146, 148 are provided, which include the plural first and second spigots 150*a*, 150*b*, 152*a*, 152*b* separated mutually by predetermined distances in the radial direction, and the first and second spigots 150*a*, 150*b*, 152*a*, 152*b* are formed in an offset manner only in the radial direction, and are not offset mutually in the axial direction (the direction of arrows A and B). Therefore, in the case that a cylinder tube is to be exchanged with a cylinder tube 12*a* of a different diameter, by exchanging the cylinder tube with the cylinder tube 12*a* of the same length, it is possible to carry out such an exchange without altering the stroke of the piston 18, 18*a*. Along therewith, when the fluid pressure cylinder 140 is installed on an assembly line, the fluid pressure cylinder 140 can be attached reliably at the prior attachment position, without requiring changes to the attachment position (attachment pitch) of the head cover 142 and the rod cover 144. As a result, the bore diameter of the fluid pressure cylinder 140, which is used on an assembly line, can easily be changed, and the fluid pressure cylinder 140 can easily and reliably be installed with respect to the assembly line.

In the fourth embodiment above, a case has been described in which one type of cylinder tube 12 (12*a*) is capable of being mounted on each pair of the first and second spigots 150*a*, 152*a*, and the first and second spigots 150*b*, 152*b*, on the first and second spigot joints 146, 148. However, the invention is not limited to this structure. For example, a structure may be provided in which the annular shaped first and second spigots 150*b*, 152*b* are expanded radially, and two types of cylinder tubes 12 (12*a*) are capable of being positioned on one pair of the first and second spigots 150*b*, 152*b*, i.e., on inner circumferential surfaces of the first and second spigots 150*b*, 152*b* and on outer circumferential surfaces thereof.

More specifically, two types of cylinder tubes 12 of different diameters can be installed and positioned with respect to the first and second spigots 150*b*, 152*b*. Thus, three types of cylinder tubes 12 (including the case in which the cylinder tube 12 is mounted and positioned on the first and second spigots 150*a*, 152*a*) that differ in diameter can be installed selectively in the fluid pressure cylinder 140, and can be positioned in the radial direction and assembled.

The fluid pressure cylinder according to the present invention is not limited to the above embodiments. Various changes and modifications may be made to the embodiments without departing from the scope of the invention as set forth in the appended claims.

The invention claimed is:

1. A fluid pressure cylinder comprising:

a cylindrically shaped cylinder tube having a cylinder chamber in an interior thereof;

a first cover member mounted on one end of the cylinder tube;

a second cover member mounted on other end of the cylinder tube;

a piston disposed displaceably along the cylinder chamber; and spigot joint means, over which the cylinder tube is inserted, and which positions the cylinder tube in axial and radial directions, wherein the spigot joint means is disposed on the first and second cover members, the spigot joint means comprises at least two pairs of stepped portions of different diameters or at least two pairs of grooved portions of different diameters, an inner circumferential surface or an outer circumferential surface of the cylinder tube is installed on one pair of the stepped portions or on any one pair of the grooved portions, and a diameter of at least one pair of the stepped portions or at least one pair of the grooved portions is smaller than a diameter of the piston.

2. The fluid pressure cylinder according to claim 1, wherein the stepped portions are formed in a mutually offset manner in the axial direction of the first and second cover members.

3. The fluid pressure cylinder according to claim 1, wherein the grooved portions are provided on an inner circumferential surface and an outer circumferential surface of an annular groove formed on the first and second cover members.

4. The fluid pressure cylinder according to claim 1, wherein on the stepped portions and the grooved portions, seal members are installed on wall portions thereof against which ends of the cylinder tube abut.

5. The fluid pressure cylinder according to claim 1, wherein the fluid pressure cylinder includes only one said cylindrically shaped cylinder tube.

6. The fluid pressure cylinder according to claim 1, wherein a first length in the axial direction between a first pairs of the stepped portions or the grooved portions having a first diameter is greater than a second length in the axial direction between a second pairs of the stepped portions or the grooved portions having a second diameter, the first diameter being greater than the second diameter.

* * * * *